US005718330A

United States Patent [19]

Auffret et al.

[11] Patent Number: 5,718,330

[45] Date of Patent: Feb. 17, 1998

[54] HOLDER FOR RECEPTACLES

[75] Inventors: Jean-Paul Auffret; Jean-Marie Auffret; Marie-Thérèse Van Kerk, all of Wemmel, Belgium

[73] Assignee: Plastirock Industries S.A., Brussels, Belgium

[21] Appl. No.: 522,346

[22] PCT Filed: Mar. 15, 1994

[86] PCT No.: PCT/BE94/00021

§ 371 Date: Nov. 6, 1995

§ 102(e) Date: Nov. 6, 1995

[87] PCT Pub. No.: WO94/21526

PCT Pub. Date: Sep. 29, 1994

[30] Foreign Application Priority Data

Mar. 15, 1993 [BE] Belgium ..... 9300246

[51] Int. Cl.[6] ..... B65D 75/00

[52] U.S. Cl. ..... 206/141; 206/161; 206/199

[58] Field of Search ..... 206/161, 427, 206/199, 139, 141; 294/87.2

[56] References Cited

U.S. PATENT DOCUMENTS

| | | | |
|---|---|---|---|
| 3,084,792 | 4/1963 | Pqupitch | 294/87.2 |
| 3,285,410 | 11/1966 | Brunsing | 206/199 |
| 3,294,270 | 12/1966 | Geisler | 217/21 |
| 3,587,847 | 6/1971 | Graser | 294/87.2 |
| 3,653,504 | 4/1972 | Saumsiegle | 294/87.2 |
| 3,884,354 | 5/1975 | Guenther et al. | 206/427 |
| 3,946,862 | 3/1976 | Klygis et al. | 294/87.2 |
| 4,267,223 | 5/1981 | Swartz | 428/172 |
| 4,401,212 | 8/1983 | Fischer . | |
| 4,448,452 | 5/1984 | Wood | 206/161 |
| 4,453,630 | 6/1984 | Helms et al. | 294/87.2 |
| 4,474,293 | 10/1984 | Osborne . | |
| 4,678,088 | 7/1987 | Flum | 211/73 |
| 4,736,977 | 4/1988 | Killy | 294/87.2 |
| 5,445,262 | 8/1995 | Sutherland | 294/87.2 |
| 5,484,643 | 1/1996 | Wise et al. | 428/192 |
| 5,487,463 | 1/1996 | Harris | 206/161 |

FOREIGN PATENT DOCUMENTS

| | | |
|---|---|---|
| 2169442 | 1/1972 | France . |
| 2263946 | 3/1975 | France . |
| 2120303 | 4/1971 | Germany . |
| WO9308096 | 4/1993 | WIPO . |

*Primary Examiner*—Paul T. Sewell
*Assistant Examiner*—Nhan T. Lam
*Attorney, Agent, or Firm*—Birch, Stewart, Kolasch & Birch, LLP

[57] ABSTRACT

A receptacle holder for lockable necked receptacles has a plate provided with at least two apertures. Each aperture has a diameter just smaller than the maximum diameter of the neck, and the plate is made of alveolar polypropylene with a density of at least 330 g/m$^3$.

19 Claims, 5 Drawing Sheets

HOLDER FOR RECEPTACLES

FIELD OF THE INVENTION

The present invention relates to a receptacle holder for lockable necked receptacles, which holder is composed of a plate provided with at least two apertures each having a diameter just smaller than the maximum diameter of the neck.

DESCRIPTION OF THE BACKGROUND ART

Such a receptacle holder is disclosed in the international patent application WO-A-93/08096 which is prior to, but published after the priority date of the present patent application. The disclosed receptacle holder is a part of a unit which comprises a blank paper-board wrapping the receptacles together. The plate is made of a semi-rigid plastic material and serves, on the one hand, for keeping the receptacles in place and, on the other hand, as support for the empty receptacles.

The receptacle holder according to the present invention differs from the one disclosed in the prior patent application by the fact that the plate is made of alveolar polypropylene with a density of at least 330 g/m$^3$.

The prior patent application indicates that the plate is made of a semi-rigid material such as corrugated plastic for example. The particular choice of using alveolar polypropylene is not mentioned in the prior application. The elasticity of alveolar polypropylene renders this material particularly suited for use in the present invention. Indeed, polypropylene is a light water-resistant material. Moreover, polypropylene may be washed indefinitely without being deteriorated. Polypropylene can also be recycled. By choosing alveolar polypropylene for making the plate, a relatively elastic plate is obtained which does not tear easily making it perfectly reusable. Thanks to the elasticity of the employed material, the plate as such can carry the bottles without requiring a case or a blank as the known receptacle holders do. The receptacles are held with their neck or their cap in the apertures and are suspended in this way in the plate.

It has to be noted that nothing in the prior art, nor in said prior international patent application, teaches the particular choice of alveolar polypropylene. U.S. Pat. No. 3.285.410, disclosing the use of a plate as such as receptacle holder, and teaches to make the plate of a relatively rigid material. Around the aperture wherein the bottle are held reinforcements are even provided. Also the corrugated plastic material mentioned in said prior application does not teach anything about the particular choice of alveolar polypropylene. Moreover, this prior application mentions a semi-rigid material which does not indicate the use of an elastic material.

In general, a skilled person would not consider to choose an elastic material for making a receptacle holder because of the elastic property of the material. He would rather look for a rigid material because in this way the receptacles will not break so easily.

A first embodiment of a receptacle holder according to the invention is characterized in that the friction exerted by the plate onto the receptacle is such that, at the level of the cap, the force required for removing the receptacle is at least 1.5 times larger than the force required for inserting the receptacle. In this way, the receptacles can be inserted without exerting a too large force involving the risk of breaking the receptacle. The higher removal force assures, on the one hand, that the receptacle remains well secured and, on the other hand, impedes theft attempts since the receptacles cannot be removed so easily.

A second embodiment of a receptacle holder according to the invention is characterized in that said plate comprises at least four apertures and at least one handle situated substantially in the middle of the apertures. In this way, the receptacle holder is easier to handle.

Preferably, the handle is cut out in the material of said plate itself. This makes the production of the handle easier.

A third embodiment of a receptacle holder according to the invention is characterized in that it comprises at least two rows of at least three apertures, the apertures of one and the same row being aligned in the same direction as the alveoli. In this way, the receptacles are arranged in a direction perpendicular to the direction wherein the plate may be folded along one alveolus. An increased reliability is thus achieved.

BRIEF DESCRIPTION OF THE DRAWINGS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The invention will now be described more into detail with reference to the drawings which illustrate an example of embodiment of a receptacle holder, more particularly of a receptacle holder according to the invention, in which.

DETAILED DESCRIPTION OF THE PREFERRED EMBODIMENTS

Figure 1:
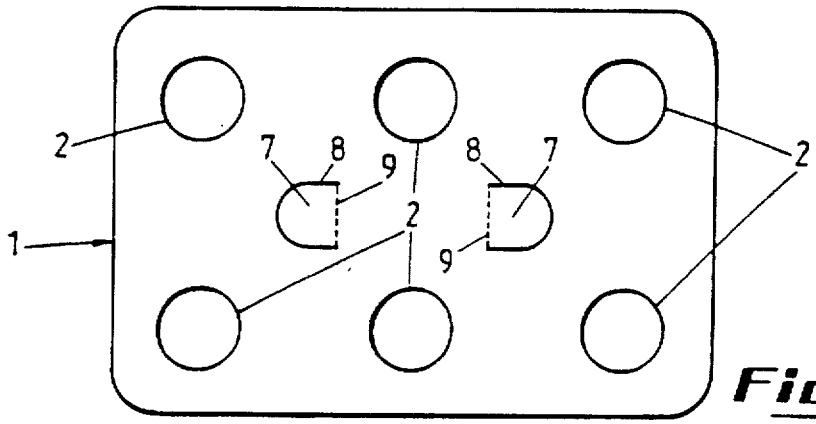
FIGS. 1 and 3 show a top plan view of examples of a receptacle holder according to the invention.

In the drawings, a same reference numeral has been given to the same or to analogous elements.

The receptacle holder according to the invention is designed for carrying different types of receptacles such as for example bottles, glass or plastic pots, flasks or tubes. The receptacle holder may carry for example bottles provided with a cap or a stopper, jam pots, shampoo flasks or tooth-paste tubes. One and the same receptacle holder may carry identical receptacles but it is also possible to design a receptacle holder for different receptacles such as for example for a bottle of spirits and a bottle of a non-alcoholic drink. Moreover, the receptacles carried by a same receptacle holder do not necessarily have to be of the same size.

In the example illustrated in FIG. 1, the receptacle holder is a bottle holder comprising six apertures 2 and therefore destined for carrying six bottles. The width of the apertures is chosen so as to be just smaller than the maximum diameter of the bottle neck. In this way, the bottle is held with its neck or with its cap in the aperture. Of course, this relates to an embodiment given only by way of example without limiting the invention.

As a matter of fact, the bottle holder 1 according to the invention may comprise a larger or smaller number of apertures for carrying for example eight or three or four or even two bottles. In the case wherein the bottle holder is arranged for carrying different types of bottles having different necks, the diameters of the apertures will inevitably be different. The surface area of the bottle holder 1 depends on the number of bottles to carry and on the bottle size. For example for a bottle holder for six lemonade bottles, the dimensions of the plate forming the bottle holder are of 18.5×12.7 cm.

Figure 2:
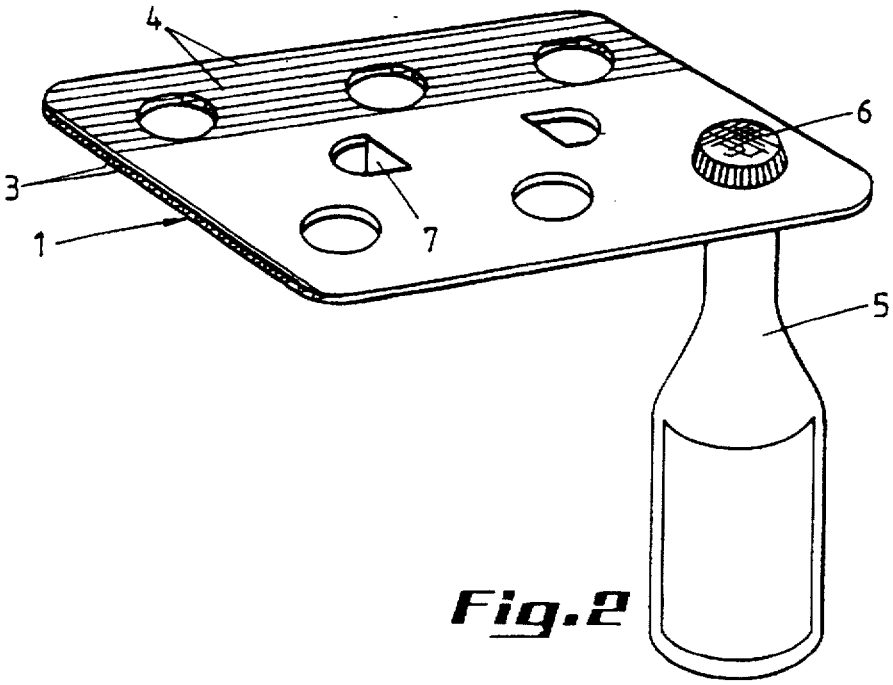
FIG. 2 shows a perspective view of a receptacle holder according to the invention.

As illustrated in FIG. 2, the bottle holder according to the invention is composed of a plate having a substantially flat surface. The plate is made of alveolar polypropylene with a density of at least 330 g/m$^3$. The alveolar polypropylene can be seen in the presence of alveoli 3 in the thickness of the plate, which makes the plate look as if it was a cardboard plate, of course it is not made of cardboard. The alveoli have a thickness comprised for example between 2 and 4 mm.

Preferably, the surface of the plate is corrugated so as to have grooves 4 extending in the surface of the plate at the partition walls between two alveoli. The choice of alveolar polypropylene renders the plate elastic without affecting the structural rigidity of the plate. This elasticity is very advantageous for permitting the bottles 5, having their neck passed through the apertures 2, to be removed.

The density of the polypropylene is at least equal 330 g/m$^3$ and is chosen in function of the size, the weight and the number of receptacles to be secured to the plate. As the receptacles are larger, heavier and in a larger number, the density of the polypropylene will be higher. By making polypropylene with a density of at least 650 g/m$^3$, the plate becomes more rigid without loosing its elasticity. According to the weight of the receptacles to be carried, the polypropylene density will vary between 330 g/m$^3$ and for example 1500 g/m$^3$. The plate may even become so rigid to be usable as bottle opener. Indeed, the cap 6 of the bottle 5 projects out of the surface of the plate. When the plate is sufficiently rigid, the bottle has only to be withdrawn obliquely out of the aperture such that the edge of the cap engages the plate. By pulling out the bottle, it will thus be opened.

As illustrated in FIG. 2, the plate comprises two rows each of three apertures, the apertures of one and the same row being aligned in the same direction as the direction of the alveoli 3. As a matter of fact, the plate can be folded easier along a groove 4 separating two successive alveoli 3 than in a direction perpendicular to these grooves 4. The homogeneity of the plate and its reliability are therefore better assured if the apertures are disposed in the direction applied in FIG. 2. Moreover, the folding of the plate opposite to this direction is avoided and the bottles are prevented from knocking against one another upon lifting the unit which is composed of receptacle holder and receptacles secured thereto.

Figure 4:
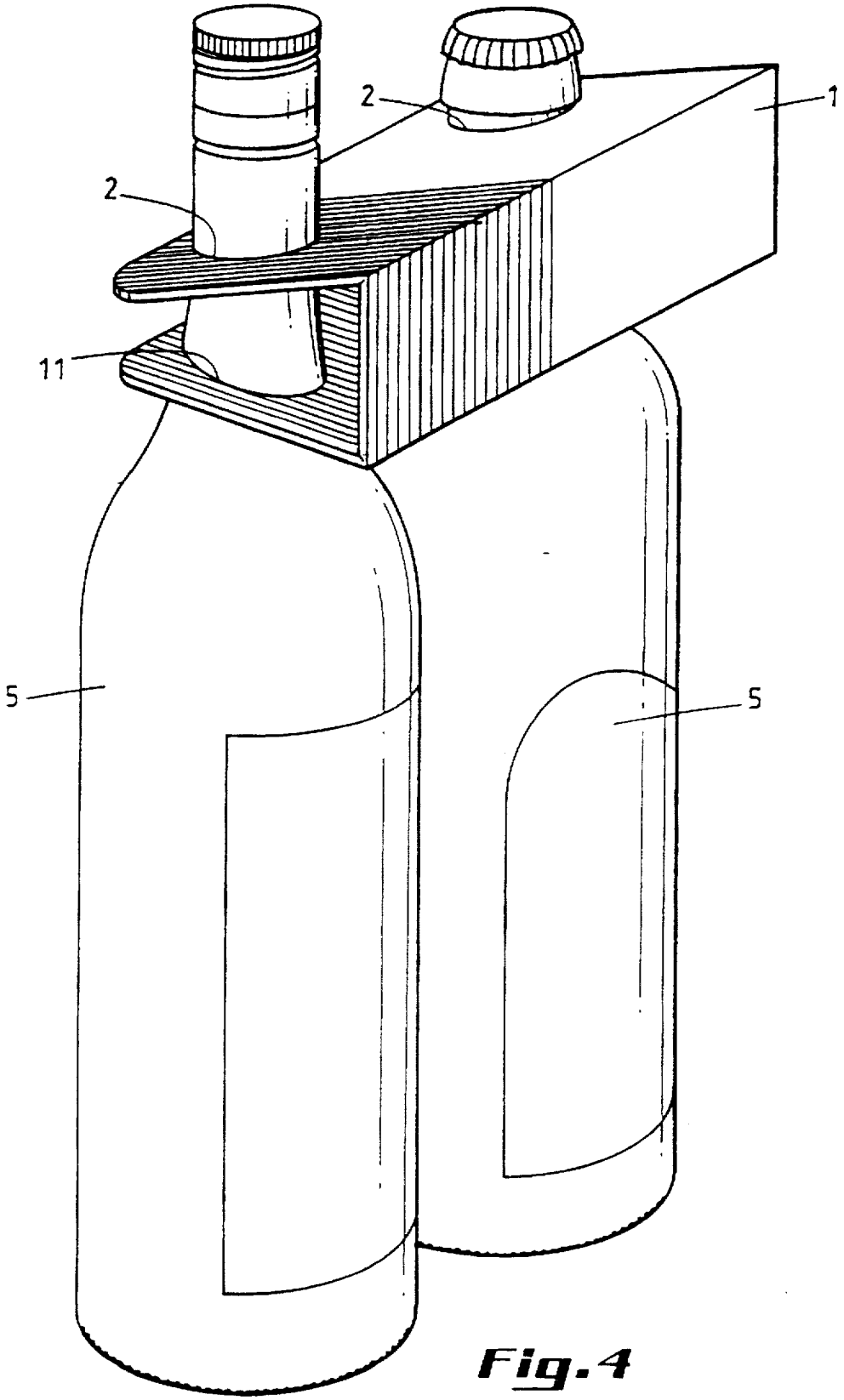
FIG. 4 illustrates another embodiment of a receptacle holder according to the invention.

According to another embodiment, the plate is folded substantially according to a U shape as illustrated in FIG. 4. The aperture 11 has a larger diameter than the one of aperture 2 and is aligned according to the axis of the neck of the receptacle for which it is destined. Thus, for example, if the receptacle has a duck's-bill like neck, the apertures will be shifted with respect to one another. In the illustrated example, the apertures 2, 11 are each aligned two by two. The diameter of the aperture 11 is larger due to the fact that the bottle neck is generally larger at this location.

Figure 7:
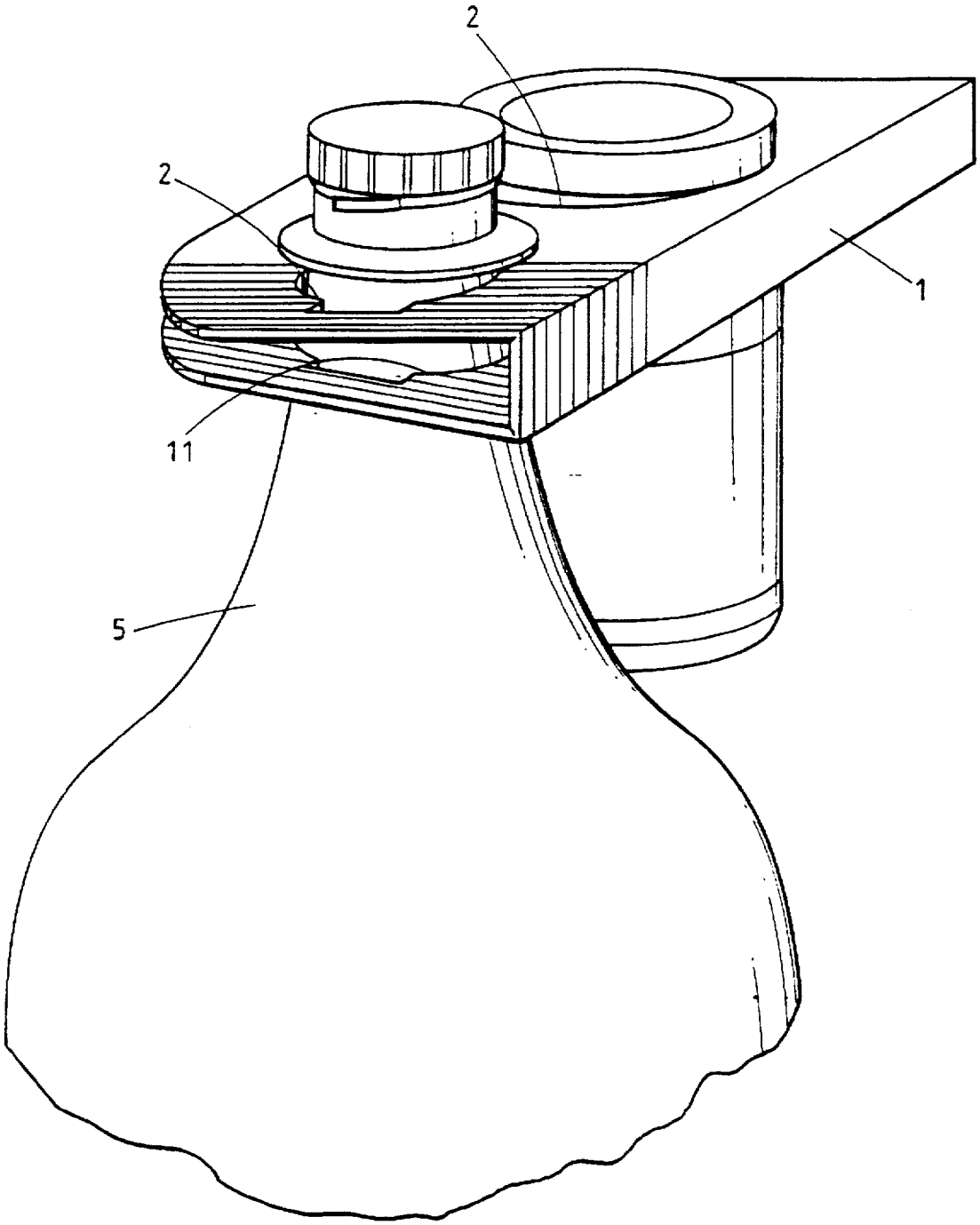
FIG. 7 illustrates a receptacle holder according to the invention to which two receptacles of different dimensions are secured.

In the example illustrated in FIG. 4, the receptacles are of a comparable size and weight. The receptacle holder according to the invention may also carry receptacles of different sizes and weights, as illustrated in FIG. 7, wherein the receptacle holder carries a bottle and a jar. The jar is suspended in the space by means of the aperture and does not rest onto a support. The retaining force exerted by the aperture onto the jar enables to keep it in place. If necessary, the plate may also be provided with a handle which makes it easier to grip.

Figure 5:
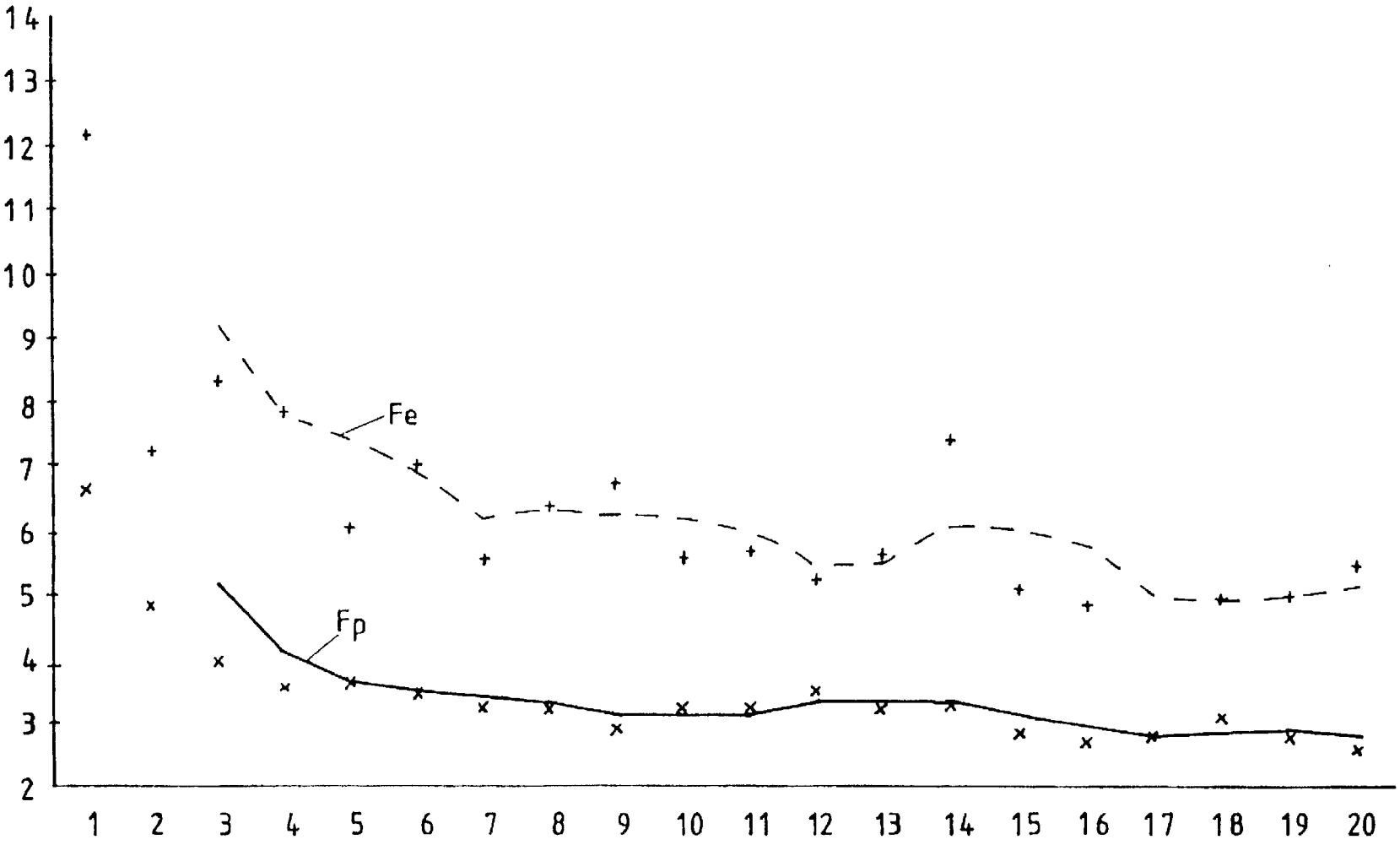
FIGS. 5 and 6 show a graph indicating the insertion and removal force at the level of the cap and respectively of the neck as dependent of the frequency.

FIG. 5 illustrates a graph wherein the removal force ($F_c$) and the insertion force ($F_p$) at the level of the cap are shown as dependent on the frequency. The term frequency indicates here a succession of insertions and removals of a receptacle in one and the same aperture of the same receptacle holder. When considering the graph, it can be seen that the force is larger for the initial insertions and removals. This can be explained by the fact that at the beginning the material structure itself resists to the exerted force. When the temporary initial phase is over, the material has a quasi stable state and it can be seen that the exerted force is no longer subject to large changes. The removal force is stabilized at about 5 daN while the insertion force is stabilized at about 3 daN. Consequently, there is a factor of at least 1.5 between the force for removing the cap and the force for inserting it.

An advantage of this difference is that it renders the removal more difficult, which provides secure retention of the receptacles in the receptacle holder and an impediment to theft attempts. The fact that less force is required for the insertion is advantageous for the manufacturer because required energy is lower and therefore production costs may be limited.

Figure 6:
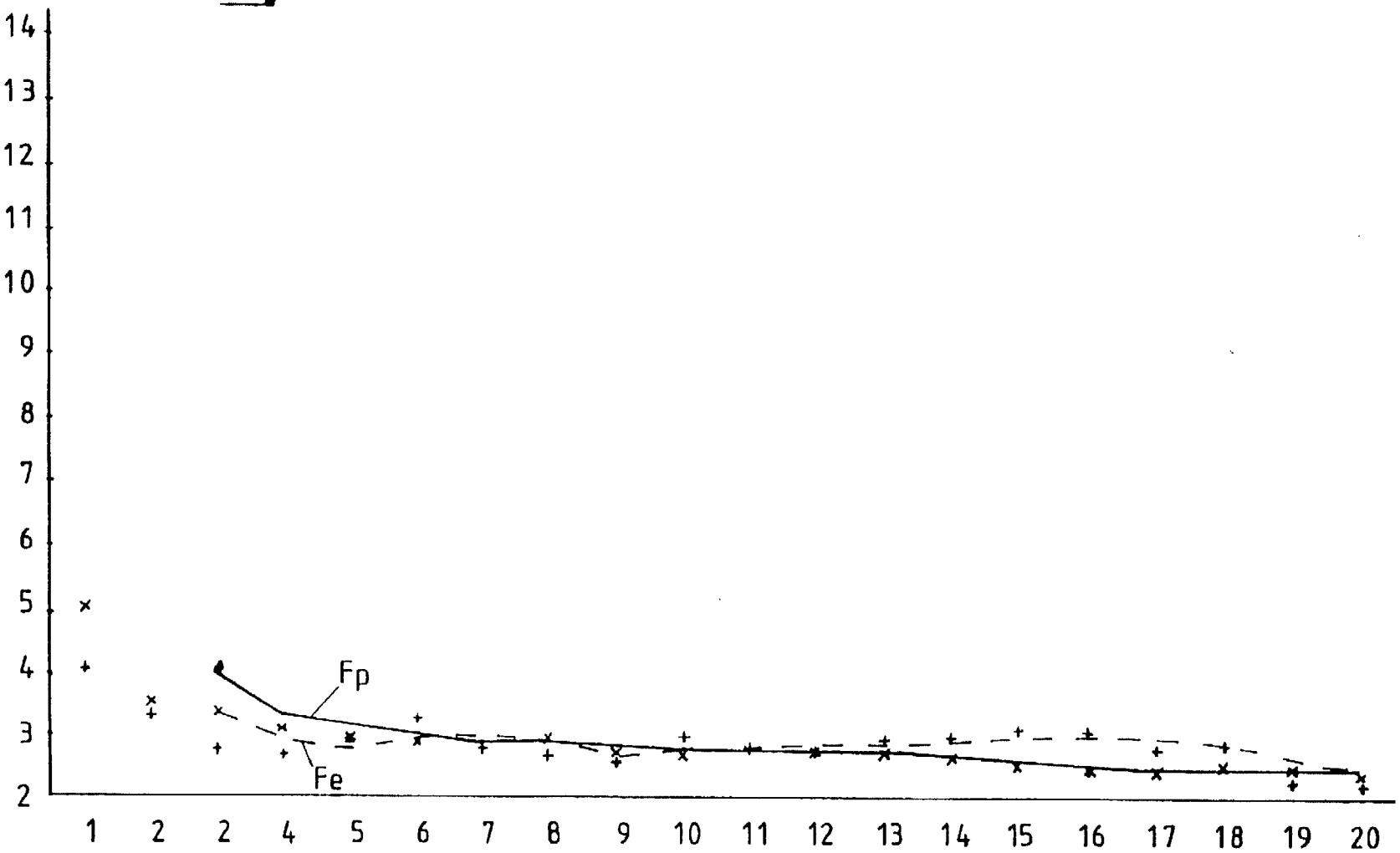

FIG. 6 illustrates a graph wherein the removal force $F_c$ and the insertion force $F_p$ at the level of the neck are shown as dependent on the frequency. It can be seen that at the level of the neck, the insertion force is nearly equal to the removal force. Nevertheless, a receptacle holder with a density of 600 g/m$^3$ requires an average force of 3daN. For a receptacle, the weight of which is generally lower than 2 kg, this means a considerable removal force. In this way, the alveolar polypropylene material itself provides high retaining force exerted onto the receptacles, which renders this material particularly suited for being used as receptacle holder. The elastic property of polypropylene have prevented a priori the skilled artisan from choosing it as receptacle holder. Its elastic property combined with its structural rigidity allows it in a surprising way to exert this large retaining force onto the receptacles. The material is sufficiently rigid for permitting the receptacles to be retained.

In order to provide a handy grip for the receptacle holder and the receptacles secured thereto, the plate is preferably provided with at least one handle 7. The example illustrated in FIGS. 1 to 3 comprises two handles, each of which being situated substantially in the middle of four apertures 2. The number of handles will of course be dependent on the size of the plate.

Preferably, the handle is made from the plate itself, by a cutting line 8 in the material of the plate. The cutting line has been drawn substantially in the shape of the extremity of a finger. For taking the bottle holder provided with bottles in the hand, a finger has only to be pushed into the handle to cause this handle to be folded along the line 9 into the direction of the receptacles as illustrated in FIG. 2. The user can put his finger then in the so-formed opening for taking hold of the unit comprised of a bottle holder and bottles.

Since the plate forming the bottle holder is substantially flat, the bottle holder according to the invention can easily be combined with existing cases. Due to the relatively small size and since the plate extends only at the level of the bottle necks, the,plate does not hamper or does not interfere with the partition walls provided in the case.

Figure 3:
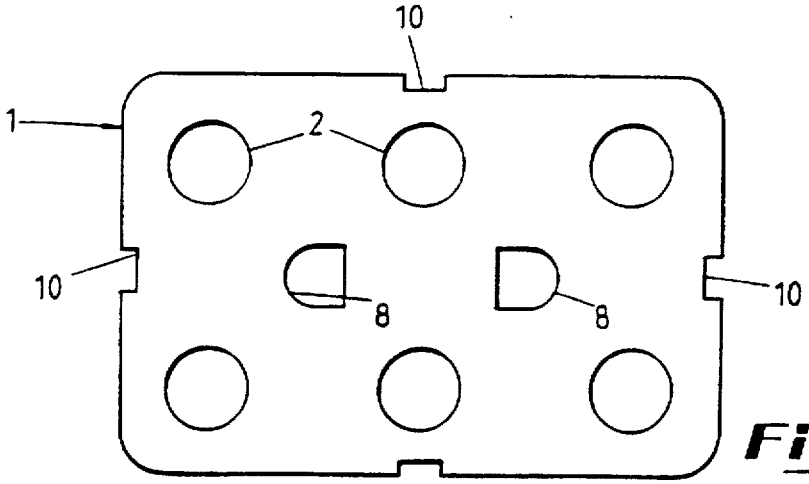

Sometimes, the cases have reinforcing ribs provided within the case. In order to be compatible with the presence of such ribs, the plate may be provided with notches 10 as illustrated in FIG. 3. Of course, the size and the location of the notches will be determined by the ribs of the case.

The use of polypropylene has as advantage that it is a recyclable material having an excellent fold resistance. In this way, the plate may be reused and will be returnable, which constitutes in this way a big advantage from an ecological point of view. Moreover, polypropylene may be washed indefinitely which accentuates its reusable aspect. Alveolar polypropylene does not tear easily, which makes the plate reusable for several times, at least 20 times, before being crushed and recycled.

Alveolar polypropylene has the further advantage of being easy to print and to be given different shapes.

This invention being thus described, it will be obvious that the same may be varied in many ways. Such variations are not to be regarded as a departure from the spirit and scope of the invention, and all such modifications as would be obvious to one skilled in the art were intended to be included within the scope of the following claims.

We claim:

1. A receptacle holder for lockable necked receptacles comprising:

a plate having uniform thickness; the plate being provided with at least two apertures each having a diameter just smaller than the maximum diameter of the neck, said plate being made of alveolar polypropylene with a density of at least 330 g/m$^3$, and the receptacle each lockable by means of a cap, where friction exerted by the plate onto each receptacle is such that, at a level of each cap, a force required for removing the receptacle is at least 1.5 times larger than a force required for inserting the receptacle.

2. A receptacle holder according to claim 1, wherein friction exerted by the plate onto each receptacle is such that, at a level of each neck, a force for removing and for inserting each receptacle is at least equal to 2.5 daN.

3. A receptacle holder according to claim 2, wherein said plate comprises at least four apertures and at least one handle situated substantially in the middle of the apertures.

4. A receptacle holder according to claim 2, wherein the plate is folded substantially according to a U-shaped and provided with an even number of apertures each aligned two by two according to the axis of the neck of the receptacle for which they are destined.

5. A receptacle holder according to claim 2, further comprising:

at least two rows of at least three apertures each, the apertures of one and the same row being aligned in the same direction as the alveoli.

6. A receptacle holder according to claim 1, wherein said plate comprises at least four apertures and at least one handle situated substantially in the middle of the apertures.

7. A receptacle holder according to claim 6, wherein the handle is cut out in the material of said plate.

8. A receptacle holder according to claim 7, wherein the plate is folded substantially according to a U-shaped and provided with an even number of apertures each aligned two by two according to the axis of the neck of the receptacle for which they are destined.

9. A receptacle holder according to claim 7, further comprising;

at least two rows of at least three apertures each, the apertures of one and the same row being aligned in the same direction as the alveoli.

10. A receptacle holder according to claim 6, wherein the plate is folded substantially according to a U-shape and provided with an even number of apertures each aligned two by two according to the axis of the neck of the receptacle for which they are destined.

11. A receptacle holder according to claim 6, further comprising:

at least two rows of at least three apertures each, the aperture of one and the same row being aligned in the same direction as the alveoli.

12. A receptacle holder according to claim 1, wherein the plate is folded substantially according to a U-shape and provide with an even number of apertures each aligned two by two according to the axis of the neck of the receptacle for which they are destined.

13. A receptacle holder according to claim 1, wherein the plate has alveoli extending therethrough and wherein the receptacle holder further includes at least two rows of at least three apertures each, the apertures of at least one row being aligned in a same direction as the alveoli.

14. A receptacle holder according to claim 1, wherein the friction exerted by the plate onto the receptacle is such that, at a level of each neck, the force for removing and for inserting the receptacle is at least equal to 2.5 daN.

15. A receptacle holder according to claim 1, wherein said plate comprises at least four apertures and at least one handle situated substantially in the middle of the apertures.

16. A receptacle holder according to claim 1, wherein the plate is folded substantially according to a U-shaped and provided with an even number of apertures each aligned two by two according to the axis of the neck of the receptacle for which they are destined.

17. A receptacle holder according to claim 1, further comprising:

at least two rows of at least three apertures each, the apertures of one and the same row being aligned in the same direction as the alveoli.

18. A receptacle holder according to claim 1, wherein said plate is substantially planar in an unflexed state.

19. A receptacle holder according to claim 1, wherein said areas of the plate adjacent and encircling the aperture are in the plane of the plate in an unflexed state such that all of said plate is flat.

* * * * *